US006492960B2

(12) United States Patent
Sullivan

(10) Patent No.: US 6,492,960 B2
(45) **Date of Patent: *Dec. 10, 2002**

(54) PLASTIC OR DIE-CAST ANTENNAS FOR A WIRELESS COMMUNICATIONS DEVICE

(75) Inventor: Jonathan L. Sullivan, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/966,974

(22) Filed: Sep. 28, 2001

(65) Prior Publication Data

US 2002/0014997 A1 Feb. 7, 2002

Related U.S. Application Data

(63) Continuation of application No. 09/303,948, filed on May 3, 1999, now Pat. No. 6,359,598.

(51) Int. Cl.[7] ..... H01Q 1/36

(52) U.S. Cl. ..... 343/895; 343/702; 343/725

(58) Field of Search ..... 343/702, 715, 343/900, 901, 895, 725; H01Q 1/24, 1/36

(56) References Cited

U.S. PATENT DOCUMENTS

| | | | | |
|---|---|---|---|---|
| 5,650,789 A | * | 7/1997 | Elliott et al. | 343/895 |
| 5,734,351 A | | 3/1998 | Ojantakanen et al. | |
| 5,905,475 A | | 5/1999 | Annanaa | |
| 5,914,697 A | | 6/1999 | Seki | |
| 5,990,848 A | | 11/1999 | Annamaa et al. | |
| 6,147,660 A | * | 11/2000 | Elliott | 343/895 |

* cited by examiner

*Primary Examiner*—Michael C. Wimer
(74) *Attorney, Agent, or Firm*—Thomte, Mazour & Niebergall; Dennis L. Thomte

(57) ABSTRACT

An antenna is described for use with a wireless communications device wherein the antenna comprises a helical radiator having a connector at one end thereof with the helical radiator and connector being of one-piece, unitary construction. In one embodiment, the radiator and connector are formed through a plastic injection molding procedure while in another embodiment, the radiator and connector are formed by use of a metal die-casting procedure. Modified forms of the antenna are also disclosed.

6 Claims, 5 Drawing Sheets

PLASTIC OR DIE-CAST ANTENNAS FOR A WIRELESS COMMUNICATIONS DEVICE

CROSS-REFERENCE TO RELATED APPLICATION

This is a continuation application of Petitioner's earlier application Ser. No. 09/303,948 filed May 3, 1999, now U.S. Pat. No. 6,359,598, entitled A PLASTIC OR DIE-CAST ANTENNA FOR A WIRELESS COMMUNICATIONS DEVICE.

BACKGROUND OF THE INVENTION

1. Field of the Invention

This invention relates to an antenna for use with a wireless communications device and more particularly to a fast and efficient method of manufacturing low cost antennas for cellular telephones and other wireless communications devices. This is accomplished by reducing the number of components in the antenna assembly and developing manufacturing techniques that are reliable, repeatable and consistent.

2. Description of the Art

The wireless communications industry is growing at an alarming rate. The growth is, for the most part, driven by the cellular telephone industry. The fact that cellular telephone usage is becoming very affordable allows almost everyone to use them. Along with this astonishing growth comes stiffer competition at every segment of the business. Any provider of products or services to the industry is forced to search for new ways to reduce the cost of the products they supply. Handset manufacturers especially realize they must reduce costs on every component of the handset to stay competitive in the market.

Currently, there are several types of antennas that are used for wireless devices. Antennas for cellular handsets may be categorized into two main groups, that is, the fixed stubby antenna and the retractable antenna. The prior art stubby antenna illustrated in FIG. 1 is usually a 1/4 wave-length antenna and is simply a helical-shaped conductor (spring) attached to a metal connector with a cover enclosing the same. The conventional method of construction is to machine or die-cast a connector from metal, attach a helical-shaped radiator thereto by soldering or crimping and then attaching a cover to protect the antenna. The helical-shaped radiator is simply a wire that is wound into a spring by using conventional spring winding techniques.

The prior art retractable antenna of FIG. 2 is a modified stubby antenna with a conductive elongated radiator that slides through the center of the stubby antenna. The conductive whip section may be retracted into the phone while not in use or extended for enhanced performance. Inherent design features of the retractable antenna limit performance and manufacturing efficiency. One problem that occurs in the prior art antennas is the fabrication of the helical-shaped radiator (spring). If the desired spring geometry involves anything other than the normal spring design, it is difficult, if not impossible to produce. This is due to the normal process limitations of the spring winding technology. Also, depending upon the initial setup of the spring winding machine, variations in coil dimensions are common. Further, depending upon the material used, unwanted stresses are induced into the spring material while it is being formed. Unless the springs are post-treated to remove the stresses, the spring dimensions can change over time, causing electrical performance variations. Still another issue involved with the conventional design is the reliability of the connection of the spring to the connector.

SUMMARY OF THE INVENTION

An antenna is described for use with a wireless communications device such as a cellular telephone or the like wherein the antenna includes a helical radiator having a connector at one end thereof which is electrically connected thereto. The radiator and the connector are of one-piece unitary construction which may be either an injection molded plastic material or a metal die-casting material. The radiator and conductor are metalized with an electrically conductive material. In a second embodiment of the invention, an elongated radiator is slidably movably positioned within the helical radiator. In yet another embodiment of the invention, an elongated radiator is positioned within the helical radiator with the helical radiator, elongated radiator and connector being formed of one-piece, unitary construction.

It is a principal object of the invention to provide a method for manufacturing an antenna which reduces part count, increases reliability, increases consistency and reduces cost of the antenna.

Still another object of the invention is to provide antenna designs which use metalized injection molded plastic or metal die-casting.

Yet another object of the invention is to provide an antenna which is fabricated by means of a single shot plastic injected molded process or a metal die-casted process which is then metalized with a conductive coating and enclosed by a cover.

These and other objects will be apparent to those skilled in the art.

DESCRIPTION OF THE PREFERRED EMBODIMENT

Figure 1:
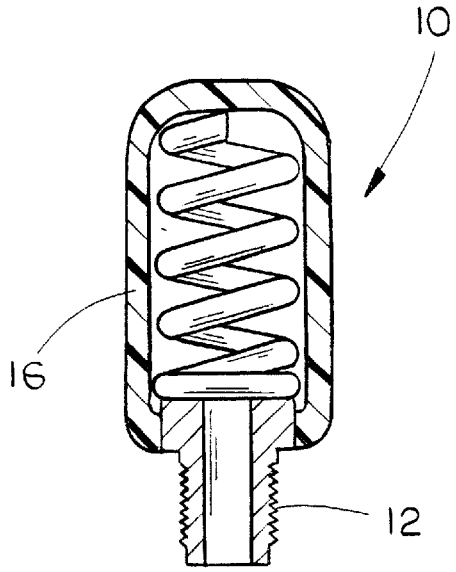
FIG. 1 (PRIOR ART)
FIG. 1 is a sectional view of a prior art antenna.

In FIG. 1, a prior art stubby antenna is referred to generally by the reference numeral 10 which is manufactured using conventional techniques. Antenna 10 is comprised of connector 12, helical radiating element 14 and antenna cover 16. The helical radiating element 14 is attached to the connector 12 by either soldering or crimping. The antenna cover 16 is either insert molded or bonded to the antenna assembly. The structure of FIG. 1 is inconsistent electrically and relatively expensive to manufacture.

Figure 2:
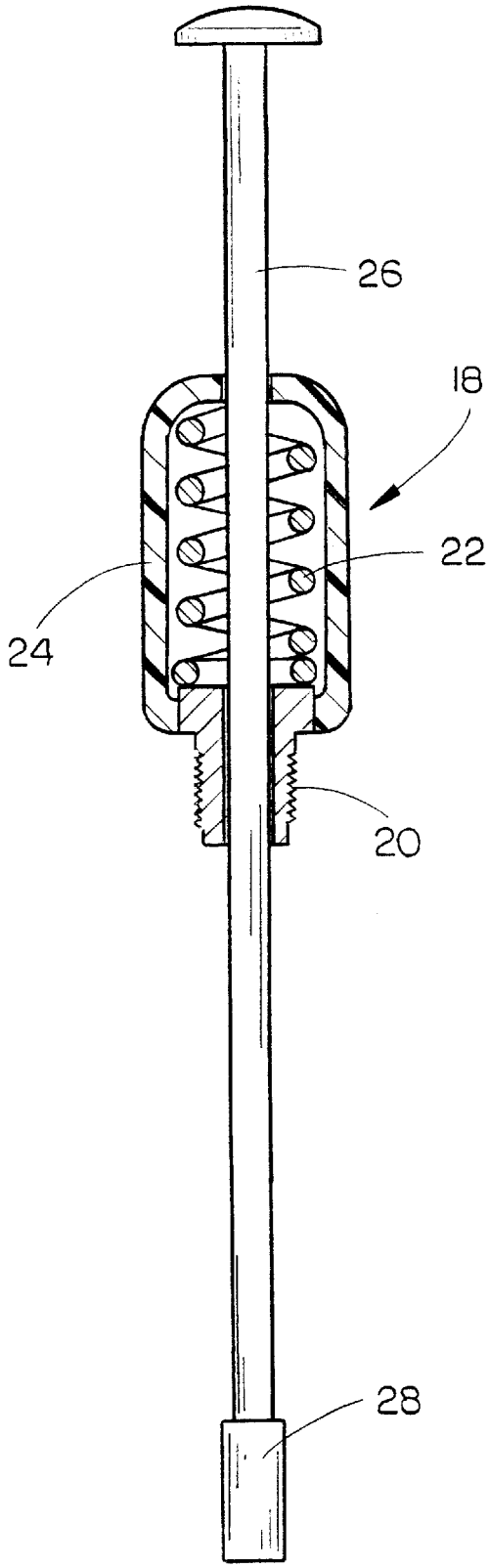
FIG. 2 (PRIOR ART)
FIG. 2 is a sectional view of a prior art antenna.

In FIG. 2, a prior art retractable antenna 18 is illustrated which is manufactured using conventional techniques. Antenna 18 comprises connector 20, helical radiating element 22, antenna cover 24, and elongated radiator 26 having a bottom stop 28. Elongated radiator 26 is slidably movable within the helical radiator 22 between retracted and extended positions in conventional fashion. The helical radiator 22 is connected to the connector 20 by either soldering or crimping. The antenna cover 24 is either insert molded or bonded to the antenna assembly. The antenna of FIG. 2 is inconsistent electrically and relatively expensive to manufacture.

Figure 3:
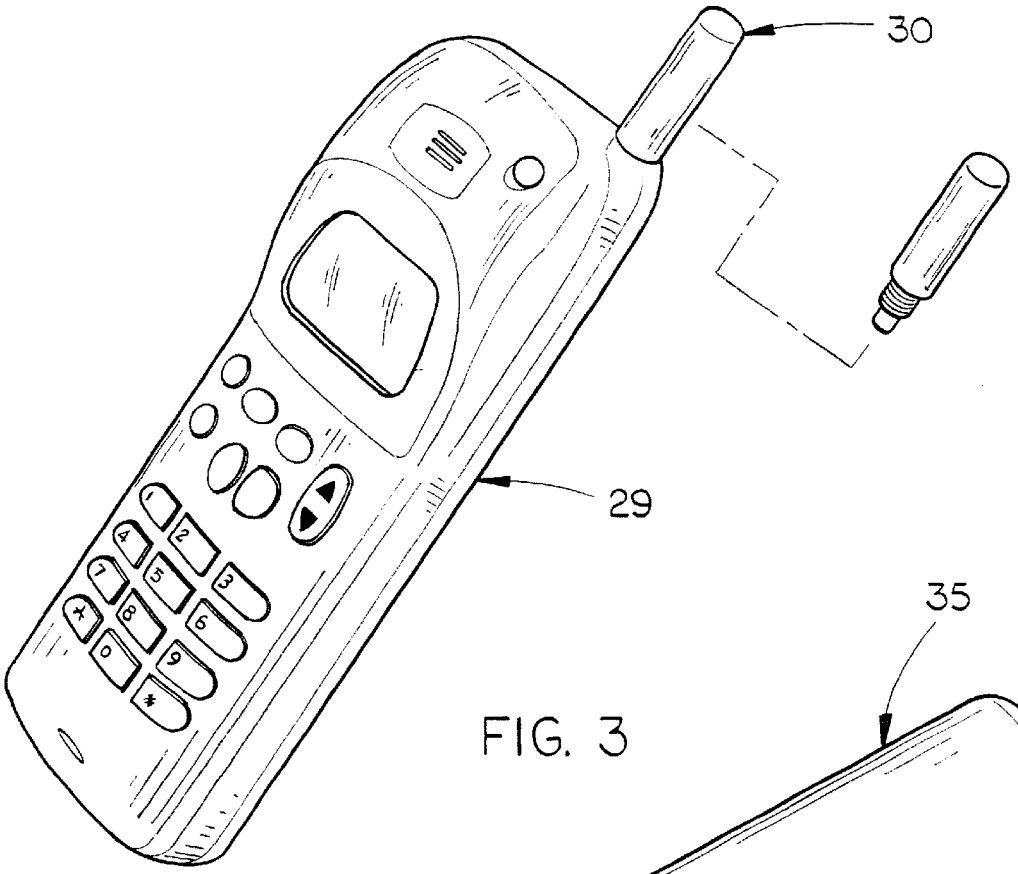
FIG. 3 is a perspective view illustrating one form of the antenna of this invention mounted on a cellular telephone.
Figure 4:
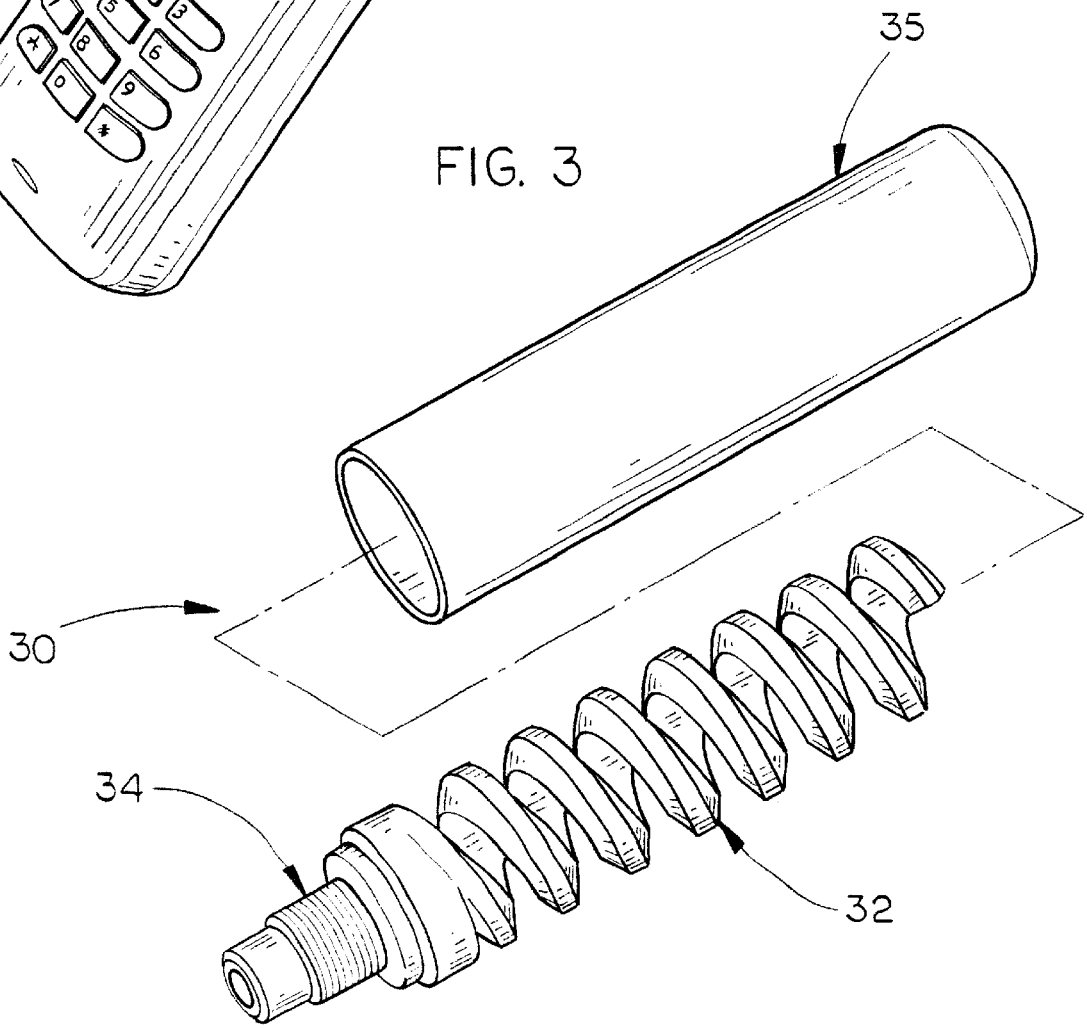
FIG. 4 is an exploded perspective view of the antenna of FIG. 3.
Figure 5:
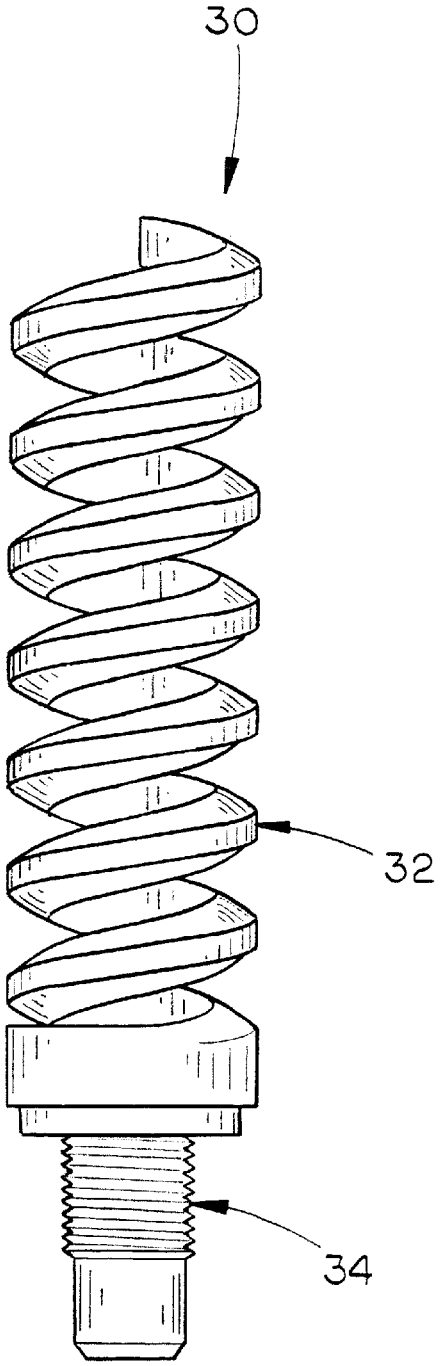
FIG. 5 is a side view of the antenna of FIG. 3 with the cover removed.
Figure 6:
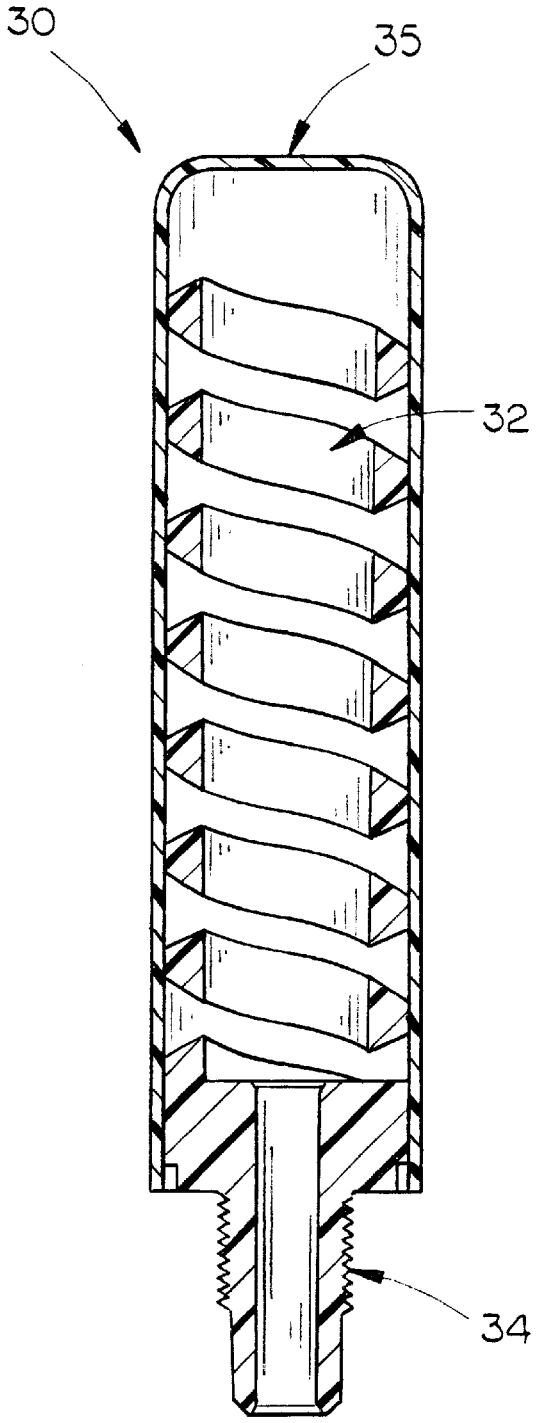
FIG. 6 is a sectional view of the antenna of FIG. 3.

In FIG. 3, the numeral 29 refers to a wireless communications device such as a cellular telephone. In FIGS. 3–6, the numeral 30 refers to a stubby antenna which is manufactured according to the method to be described hereinafter. Antenna 30 consists of a single shot plastic injected molded part or metal die-cast part which is metalized with a conductive coating and then covered by a cover. More specifically, antenna 30 includes a helical radiator 32 and connector 34 which are of one-piece, unitary construction. Radiator 32 and connector 34 may either be comprised of an injected molded plastic or a die-cast metal material. In either case, the radiator 32 and the connector 34 are metalized with an electrically conductive metal material such as copper, nickel or gold with the thickness thereof depending upon the operating parameters of the antenna. Helical radiator 32 receives or radiates RF energy with the connector 34 attaching the antenna electrically and mechanically to the wireless communications device 29. The radiator 32 of FIGS. 3–6 is of simple helix-shaped geometry. More complex radiator geometry is possible with no additional expense when using the process of this invention. The die-cast version of this part could be made from a variety of metals or metal alloys depending upon cost and mechanical properties needed. The connector 34 is shown as a threaded section, but it is possible to use a snap-fit feature that will attach the antenna to the wireless communications device. Radiator 32 is enclosed in a cover 35 which may be insert molded or bonded to the antenna assembly.

Figure 7:
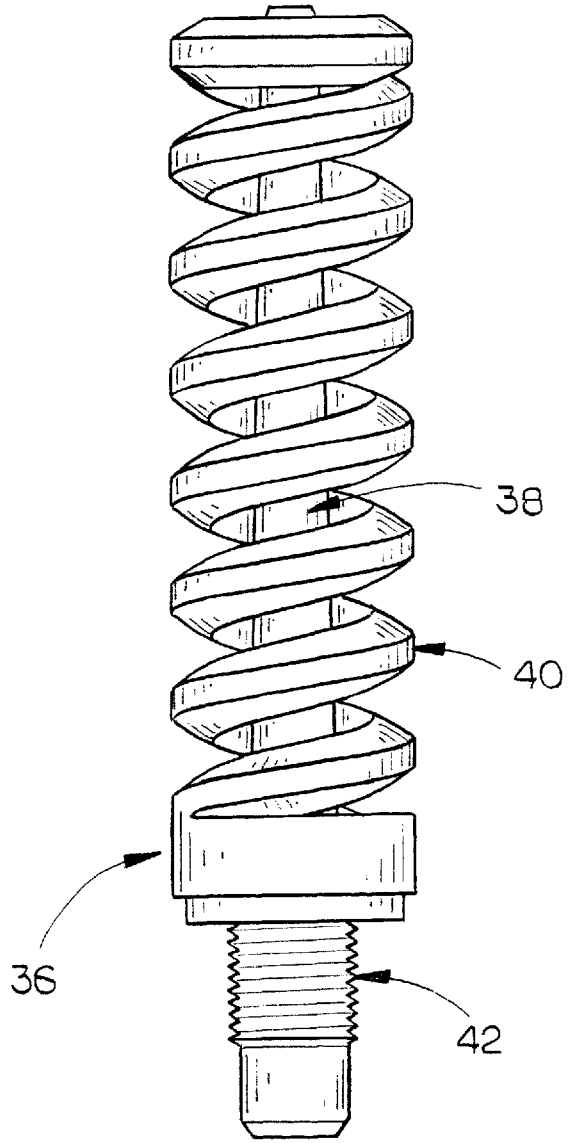
FIG. 7 is a side view of a further embodiment of the antenna, with the cover removed.
Figure 8:
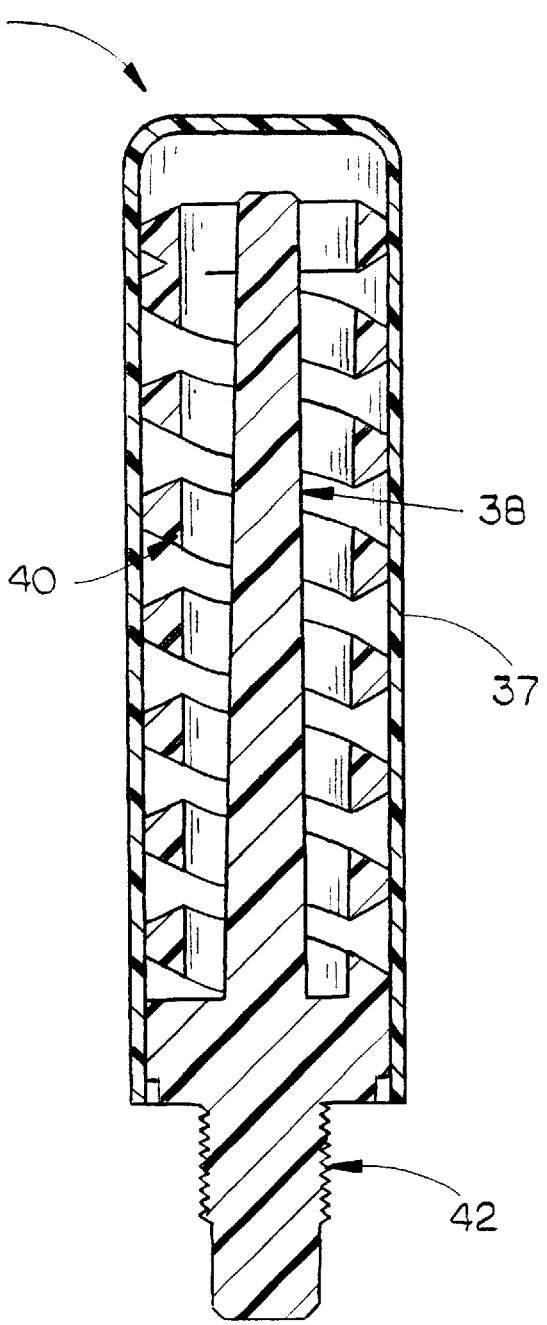
FIG. 8 is a sectional view of the antenna of FIG. 7 with the cover mounted thereon.

A modified form of the antenna is illustrated in FIGS. 7–8, and is referred to generally by the reference numeral 36. The only difference between the antenna 36 of FIGS. 7–8 and the antenna 30 of FIGS. 3–6 is that the antenna 36 is provided with an elongated radiator 38 which is positioned within the helical radiator 40. The helical radiator 40, rod radiator 38 and the connector 42 are of one-piece unitary construction formed either through plastic injection molding or metal die-casting. The radiators 38, 40 and the connector 42 are metalized as described above with respect to antenna 30. The antenna 36 includes a cover 37.

Figure 9:
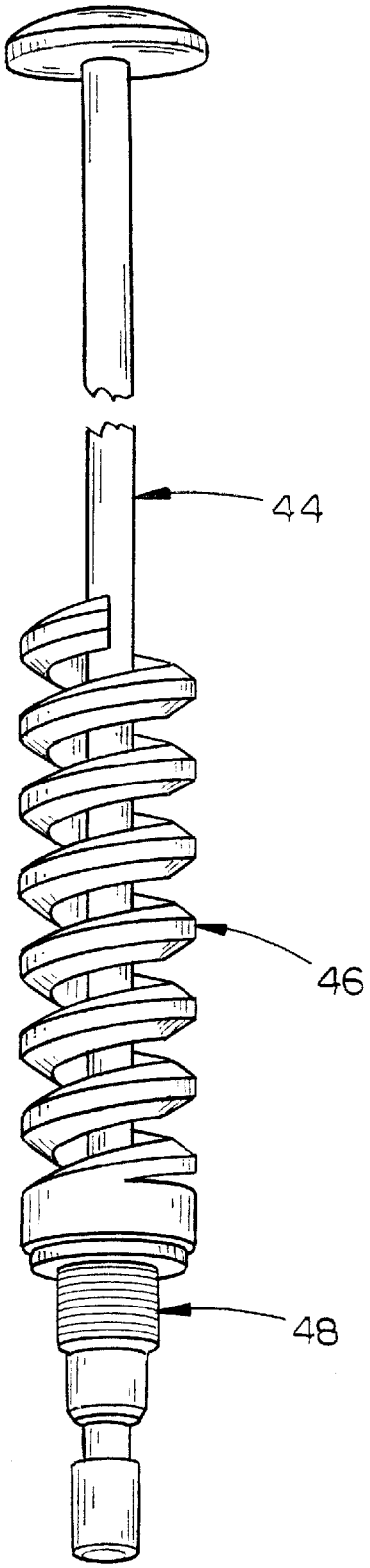
FIG. 9 is a perspective view of yet another embodiment of the antenna, with the cover removed.
Figure 10:
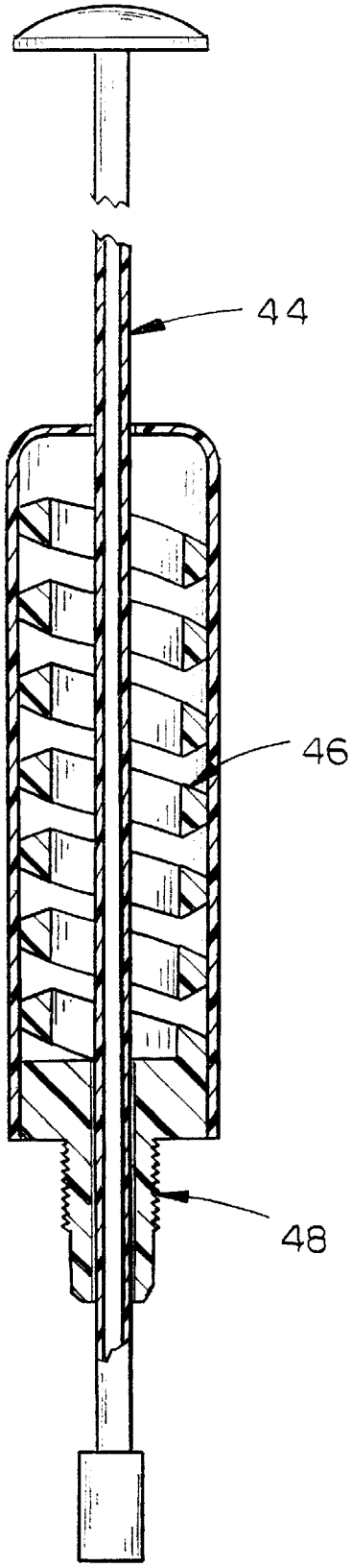
FIG. 10 is a sectional view of the antenna of FIG. 9, with the cover mounted thereon.

Yet another modified version of the antenna of this invention is illustrated in FIGS. 9–10 wherein elongated radiator 44 is slidably movable with respect to the helical radiator 46 and connector 48. In the embodiment of FIGS. 9–10, the elongated radiator 44 is not injection molded or die-cast with the helical radiator 46 and connector 48.

Thus it can be seen that a novel antenna has been provided which is fabricated by either plastic injection molding or metal die-casting.

Thus it can be seen that the antenna of this invention accomplishes at least all of its stated objectives.

I claim:

1. An antenna for use with a wireless communications device, comprising:

a helical radiator having first and second ends, comprised of a plurality of helices having outer and inner surfaces, said inner surfaces of said helices defining a central opening;

a connector at said first end of said radiator and being electrically connected thereto;

an elongated radiator extending from said connector through said helical radiator;

said connector being electrically conductive to enable said elongated radiator and said helical radiator to be electrically connected to the wireless communications device;

said elongated radiator, said helical radiator and said connector being of one-piece, unitary construction.

2. The antenna of claim 1 wherein said elongated radiator, said helical radiator and said connector are metalized with an electrically conductive metal material.

3. The antenna of claim 1 wherein a cover encloses said helical radiator.

4. The antenna of claim 1 wherein a cover encloses said helical radiator and said elongated radiator.

5. The antenna of claim 1 wherein said helical radiator and said connector are comprised of a die-cast metal material.

6. The antenna of claim 5 wherein said helical radiator and said connector are metalized with an electrically conductive metal material.

* * * * *